United States Patent [19]

Wary

[11] Patent Number: 4,513,023

[45] Date of Patent: Apr. 23, 1985

[54] METHOD OF CONSTRUCTING THIN ELECTROLUMINESCENT LAMP ASSEMBLIES

[75] Inventor: John Wary, Noblesville, Ind.

[73] Assignee: Union Carbide Corporation, Danbury, Conn.

[21] Appl. No.: 468,936

[22] Filed: Feb. 23, 1983

[51] Int. Cl.[3] ..... B05D 3/06

[52] U.S. Cl. ..... 427/54.1; 313/503; 427/66

[58] Field of Search ..... 427/54.1, 44, 53.1, 427/66; 430/139; 313/498, 503, 505

[56] References Cited

U.S. PATENT DOCUMENTS

| | | | |
|---|---|---|---|
| 2,791,723 | 5/1957 | Nagy et al. | 313/498 |
| 3,043,979 | 7/1962 | Van Geel et al. | 313/498 |
| 3,153,167 | 10/1964 | Rulon et al. | 313/498 |
| 3,197,664 | 7/1965 | Sentementes et al. . | |
| 3,238,407 | 3/1966 | Jaffe | 427/66 |
| 3,247,414 | 4/1966 | Levetan | 427/66 |
| 4,188,449 | 2/1980 | Lu et al. | 427/54.1 |

*Primary Examiner*—John H. Newsome

*Attorney, Agent, or Firm*—E. Lieberstein

[57] ABSTRACT

A method of constructing a thin electroluminescent lamp assembly comprising forming a UV curable dielectric matrix by loading nonencapsulated particles of electroluminescent phosphor into a UV curable dielectric composition, depositing a coating of such composition over the surface of a transparent conductor, curing such composition by exposure to ultraviolet light in a substantially inert atmosphere, interposing a coating of a silver conductive material in the form of a band about the periphery of the transparent conductor to form an electrical bus bar with the band having an elongated section of the same composition extending therefrom to form a first electrical lead, curing said band and electrical lead, superimposing a conductive coating over the surface of the UV curable dielectric composition with the conductive coating having an elongated section extending therefrom to form a second electrical lead laterally spaced apart from the first electrical lead, curing the conductive coating and second electrical lead and applying a protective coatings over said conductive coatings.

19 Claims, 3 Drawing Figures

METHOD OF CONSTRUCTING THIN ELECTROLUMINESCENT LAMP ASSEMBLIES

This invention relates to a method of manufacturing visible display devices from electroluminescent phosphors and more particularly to a method of making an electroluminescent light source such as a lamp in the form of a thin, flexible multi-layered assembly.

An electroluminescent lamp is basically composed of a layer of electroluminescent phosphor material typically of a metal activated zinc sulphide placed between two conductive layers one of which is transparent. When an alternating electric field is impressed across the conductors the phosphors are excited and emit photons with almost all of the radiated energy lying within the visible light spectrum. The emission spectrum and wavelength generated by the phosphors is controlled by the activator element such as copper or manganese.

Electroluminescent phosphors are inherently hygroscopic and sensitive to heat and moisture. When exposed to an excess of heat or high humidity the phosphor particles are damaged. The sensitivity of the phosphor particles to moisture is so strong that exposure even to conditions of low humidity will affect efficiency and decrease the light output capacity of the lamp in which the phosphors are incoporated. To reduce the susceptibility of the electroluminescent phosphors to heat, and more specifically to moisture, it has become the customary practice to microencapsulate the electroluminescent phosphor particles in protective enclosures composed of organic sealants. The microencapsulated particles are then incorporated in a conventional solvent based high dielectric medium typically comprising a cyanoethylcellulose solution or another suitable organic polymeric matrix dissolved in a solvent for forming an intermediate layer in the fabrication of a laminated electroluminescent lamp assembly.

An electroluminescent lamp is currently fabricated starting with a conductive non-transparent substrate of, for example, a sheet of aluminum foil upon which is coated an insulating layer of high dielectric constant material such as barium titinate. An embedment of microencapsulated electroluminescent phosphor in an appropriate solvent based composition is deposited over the dielectric layer. A transparent conductive coating formed from, for example, indium oxide and/or tin indium oxide is then deposited over the phosphor layer. A bus bar having a conductivity greater than the conductivity of the transparent conductor is applied around the periphery of the transparent conductor with electrical leads joined to both the bus bar and the aluminum foil conductor. The entire assembly excluding the connecting leads is then laminated together using plastic sheets of polyester or polycarbonate. The composition of each intermediate layer, viz., the barium titanate layer, the layer of electroluminescent phosphor composition, the indium oxide and/or tin indium oxide layer and the bus bar conductor are all solvent based coatings which are deposited in succession. A typical solvent based system may include toluene, acetone, dimethylformamide and/or tetrahydrofuran or other conventional solvents. Each solvent based layer in succession is exposed to heat to drive off the solvent before application of a subsequent layer. This manufacturing procedure is labor intensive and time consuming and has an inherent quality control problem resulting in a considerable number of unusable lamps. The high failure rate is believed to be the result of the successive application of solvent based layers. Each successive layer tends to resolvate the underlying layers thereby creating bleed-through pin-holes in the interlayered structure, which act as sites for electrical break down and failure of the structure. Another contributing factor to the high failure rate in the current manufacture of electroluminescent lamps may be due to ingress of moisture and/or contaminants through the electrical lead connection to the conducting layers. Presently, the electical leads are physically joined to the bus bar and solid conductor before the lamp is laminated. The electrical connections are difficult to seal off from the atmosphere.

An electroluminescent lamp fabricated in accordance with the method of the present invention possesses the characteristic of substantially increased resistance to moisture while allowing for substantially reduced costs of production. Increased moisture resistance is achieved in accordance with the present invention by incorporating the electroluminescent phosphor material in a UV curable matrix and exposing the matrix to ultraviolet "UV" light in a substantially inert atmosphere. It has further been found that the current manufacturing practice of microencapsulating the phosphors can be eliminated provided the phosphors are loaded into a dielectric matrix which is UV cured in a substantially inert atmosphere preferably of nitrogen. In addition since the phosphor loaded dielectric matrix is disposed intermediate the conductive layers only the phosphor loaded matrix layer need be cured by exposure to "UV" although from a cost standpoint UV curing of each layer is desirable. The method of the present invention also eliminates the prior art problem associated with joined electrical leads.

Accordingly, it is the principle object of the present invention to provide a method of constructing a thin flexible multi-layered electroluminescent lamp assembly having a substantially decreased susceptibility to humidity.

It is a further object of the present invention to provide a method of constructing an electroluminescent lamp which eliminates the conventional requirement for microencapsulation of the electroluminescent phosphors and the necessity for interposing an independent layer of barium titanate between the phosphor layer and the conductive layers.

Other objects and advantages of the present invention will become apparent from the following detailed explanation of the invention when read in conjunction with the following drawings in which.

Figure 1:
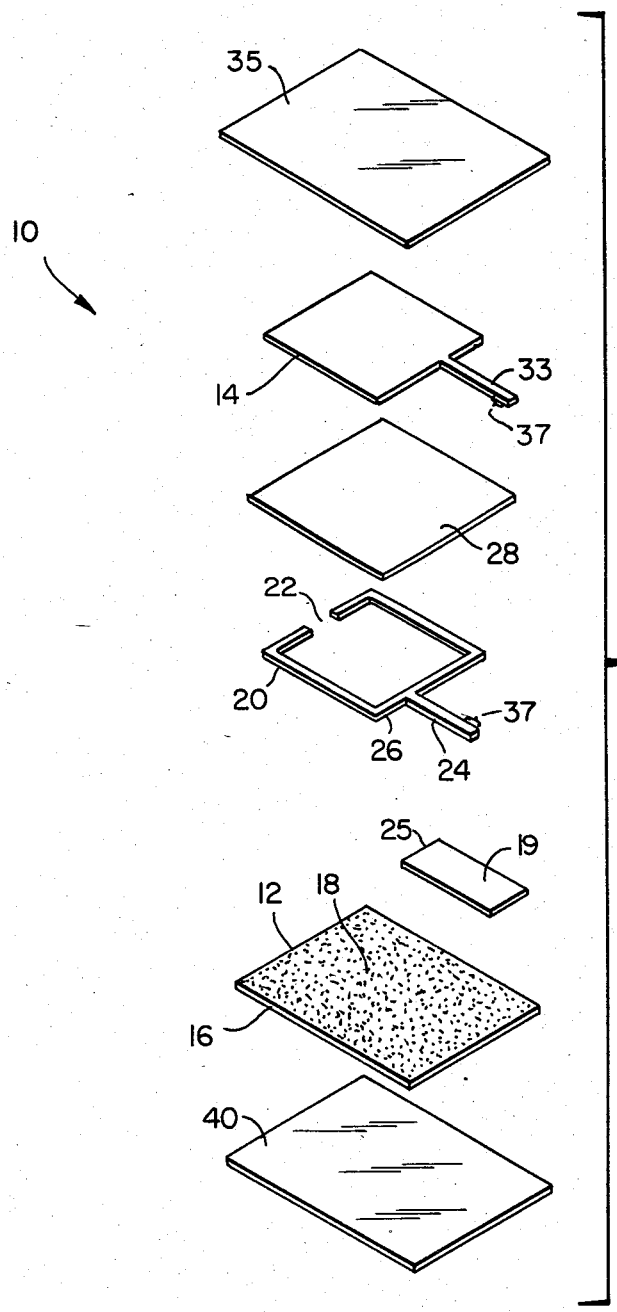
FIG. 1 is an exploded view in perspective of the multi-layered electroluminescent lamp assembly of the present invention.
Figure 2:
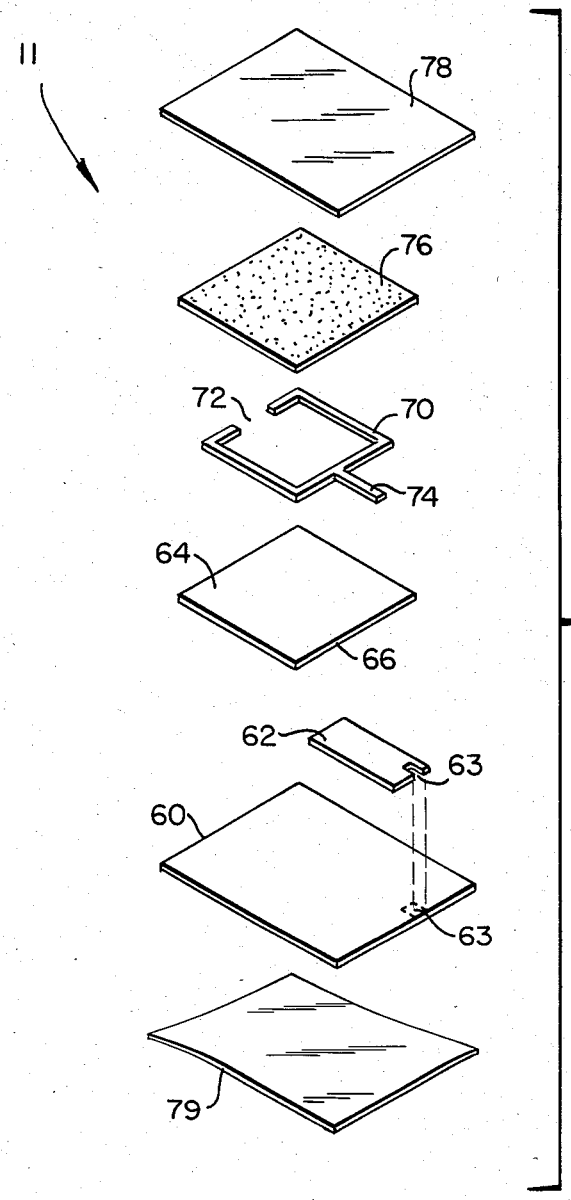
FIG. 2 is an exploded view in perspective of an alternative arrangement for the multi-layered lamp assembly of FIG. 1.
Figure 3:
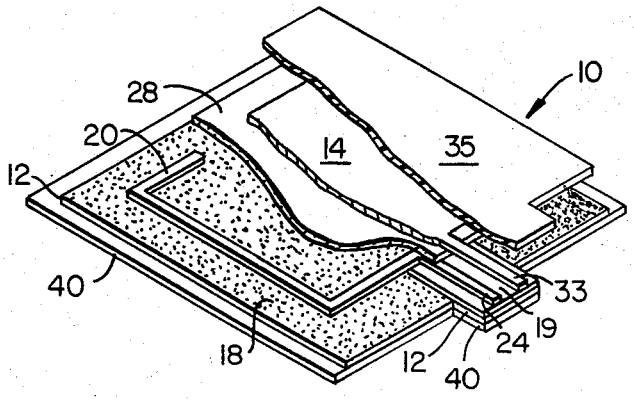
FIG. 3 is a perspective view of the fully assembled lamp of FIG. 1.

FIGS. 1 and 2 illustrate the method of the present invention for constructing a multi-layered electroluminescent lamp assembly. The fully assembled lamp is shown in FIG. 3. The lamp 10 may be constructed in accordance with the present invention starting with a transparent conductor 12 as the substrate or, conversely, starting from the opposite side of the lamp 10, using a non-transparent conductor 14 as the substrate. The transparent conductor 12 is hereafter referred to as the "light side" of the lamp whereas the non-transparent conductor 14 is hereafter referred to as the "dark side" of the lamp 10.

In assembling the lamp 10 from the light side up it is preferable for the transparent conductive substrate 12 to be formed from a sheet 16 of transparent polyester or polycarbonate having a metalized surface 18. The metalized surface 18 may be deposited by conventional vacuum metalizing techniques. The metalized surface 18 can be formed using materials such as; Indium oxide, Indium tin oxide or gold with the gold sputtered surface being illustrated herein. The thickness of the gold sputtered surface 18 is of the order of 4 angstroms. The ultra thin layer of gold 18 renders the underlying plastic sheet 16 conductive without substantially losing its transparency to light. Alternately, the transparent conductive substrate 12 may be formed by coating the sheet 16 with a thin layer of indium tin oxide or simply indium oxide and curing the coated layer.

An insulating pad 19 is screen printed upon the gold sputtered surface side of the transparent conductive substrate. The insulating composition for the pad 19 is preferably a conventional UV curable screen printable solder resist as is commercially available by the Dexter Corporation of Industry California under the tradename Hysol SR7100. The pad 19 is cured by exposure to ultraviolet light.

A conventional solvent based silver conductive composition is screen printed over the gold sputtered surface 18 to form a band 20 having a predetermined pattern which substantially encloses the perimeter of the transparent conductive substrate 12. The screen printed silver band 20 functions as an electrical bus bar for the conductive substrate 12 to uniformly distribute an applied EMF over the gold sputtered surface 18. Preferably the bus bar 20 should have an opening 22. An electrical lead 24 is simultaneously screen printed as an extension of the bus bar 20. The electrical lead 24 may be printed on the transparent conductor 12 directly over the pad 19. The end 25 of the pad 19 may lie contiguous to the side 26 of the bus bar 20 from which the electrical lead 24 extends. It should be noted that the electrical lead 24 and bus bar 20 form a single unitary coating thereby avoiding joining techniques. The electrical lead 24 is adapted to be connected to one terminal of an alternating source of voltage (not shown). A commercially available silver conductive composition for use as a screen printable silver conductive ink is sold by the Acheson Colloids Company of Port Huron Michigan under the tradename Electrodag 427SS. The silver based conductive composition forming the bus bar 20 is cured in the presence of heat in a conventional oven. It is however within the scope of the present invention to use a UV curable silver conductive composition in forming the bus bar 20 which would then be cured by exposure to a source of ultraviolet light.

The next step of the process is to deposit a coating 28 of a UV curable dielectric matrix formed by loading non-encapsulated electroluminescent phosphors in a conventional UV curable dielectric composition. It is preferred that the electroluminescent phosphors be uniformly distributed within the dielectric composition and should represent at least about 50% by weight of the total UV curable dielectric matrix. The phosphor particles may be loaded into any conventional UV curable dielectric composition such as, for example, the UV curable dielectric 5011D which is available from the Dupont Co. Inc. of Delaware U.S.A.

The phosphor loaded dielectric matrix coating 28 is cured by exposure to an ultraviolet source in an inert atmosphere. Any conventional ultraviolet light source may be used including mercury lamps, spectrally controlled mercury lamps, black lights, and germicidal lamps. A conventional full spectrum medium pressure mercury lamp system is disclosed in U.S. Pat. No. 3,933,385 the teachings of which is incorporated herein by reference. The coating is applied to the transparent substrate 12 using any conventional deposition technique such as screen printing, air-knife coating, roll coating, gravure coating, extension coating, bead coating, curtain coating and so forth.

Curing by exposure to ultraviolet radiation includes any range of wavelengths in the electromagnetic spectrum from 100 to about 4000 Angstroms. It is however critical to the present invention that the UV curable phosphor loaded dielectric matrix coating 28 be cured in an inert atmosphere preferably of nitrogen. Curing in an inert atmosphere increases the stability of the dielectric matrix containing the electroluminescent phosphors thereby decreasing the susceptibility and sensitivity of the lamp assembly to moisture. Moreover, by curing in an inert atmosphere substantially less heat is present in curing the matrix which also increases the stability and resistance of the dielectric matrix to moisture. Moreover, the dielectric properties of the matrix may also be substantially improved as a result of curing in an inert atmosphere due to less residual uncured monomer. The coating thickness and phosphor loading will determine the length of time it takes to fully cure the dielectric matrix coating 28. The coating thickness may vary with the amount of phosphor material in the dielectric which is in turn related to the desired properties for the lamp. In general the dielectric matrix coating 28 will vary from 0.2 mils to 1.2 mils thick.

In the embodiment of FIG. 1 the coating 28 covers an area at least embracing the area enclosed by the bus bar 20 with the electrical lead 24 exposed. In general the configuration of the coating 28 will define the geometry of the lamp 10 since this is the area that lights up. Although a rectangular geometry is shown in FIG. 1 it is intended only for illustrative purposes. The lamp 10 may be constructed of any planar geometrical configuration.

The non-transparent conductor 14 is then superimposed over the coating 28. An electrical lead 33 extends from the non-transparent conductor 14. The electrical lead 33 is formed as an integral part of the non-transparent conductor 14 so as to define a single unitary structure. The non-transparent conductor 14 and electrical lead 33 may be formed as a unitary structure out of a sheet of aluminum or other electrically conductive material and bonded in place over the coating 28 such that the electrical lead 33 is positioned over the insulating pad 19 adjacent to and separated from the electrical lead 24. Alternately the non-transparent conductor 14 and the electrical lead 33 may be formed as a unitary coating by screen printing a composition of electrically conductive material such as the silver conductive composition used in forming the electrical bus bar 20.

The lamp 10 may then be completed for the embodiment of FIG. 1 by superimposing a protective covering 35 over the conductor 14 which preferably also covers the electrical leads 33 and 24 except for an exposed area 37 which is left uncovered to enable the leads 33 and 24 to be electrically coupled to any standard electrical connector (not shown) which in turn is connected to the opposite terminals of an alternating source of voltage (not shown). Another protective covering 40 may also be placed beneath the transparent conductor 12. The protective coverings 35 and 40 may represent sheets of plastic such as polyester or polycarbonate or they may be formed using a screen printed clear protective coating of a screen ink formulation. Typical screen ink formulations may be found in U.S. Pat. No. 3,808,109 and in "UC curing: Science and Technology" edited by S. Pappes Technology Marketing Corporation 1973 both incorporated herein by reference. The screen ink formulation may be conventionally heat cured or UV cured. A typical UV curable screen ink formulation includes a light sensitizing photo initiator, an oligimer, a monomer and a crosslinking agent. Waste material representing any excess material extending beyond the boundary of the coating 28 may then be cut out to form a finished lamp assembly as shown in FIG. 3.

The lamp assembly of the present invention may also be made starting from the non-transparent conductor or "dark side" up as shown in FIG. 2. In this instance a strip of a solid conductor, such as aluminum foil may serve as the non-transparent conductor 60. Alternatively the non-transparent conductor 60 may be formed using a sheet of aluminum or copper foil or a sheet of laminized or metalized aluminum or copper on a polycarbonate, polyester or other non-conductive substrate.

An insulating pad 62 is then screen printed over the non-transparent conductor 60. The insulating pad 62 is composed of a screen printable solder resist composition corresponding to the insulating pad 19 of FIG. 1. A section 63 of the insulating pad 62 is removed or masked out during printing to expose a corresponding section 63 of the non-transparent conductor 60. The exposed section 63 of the conductor 60 will serve as one electrical lead of the lamp assembly.

A coating 64 of a UV curable phosphor loaded dielectric matrix composition is then screen printed over the non-transparent conductor 60 in a defined area representing any predetermined geometry. The coating 64 is screen printed in registry with the insulating pad 62 so that they substantially abut one another with the insulating pad 62 extending from one end 66 of the coating 64. The insulating pad 62 may alternatively be screen printed over the conductor 60 following the printing and curing of the matrix coating 64.

The geometry of the phosphor loaded dielectric matrix coating 64 defines the geometry of the lamp 11 and may be represented by any geometrical configuration. The phosphor loaded dielectric matrix coating 64 has a composition identical to the corresponding dielectric matrix layer 28 used in the construction of the lamp assembly 10 of FIG. 1. The phosphor loaded dielectric matrix coating 64 is cured by exposure to a source of ultraviolet light in a controlled inert gas atmosphere of preferably nitrogen in the same manner as discussed heretofore with respect to the dielectric matrix layer 28 of FIG. 1.

A band 70 of a conventional solvent based silver conductive composition equivalent to the silver conductive band 20 of FIG. 1 is screen printed over the phosphor loaded dielectric matrix coating 64. The band 70 should form a pattern which substantially encloses the perimeter of the phosphor loaded dielectric matrix coating 64. The silver conductive band 70 should have an opening 72 on one side and a pigtail 74, representing an electrical conducting lead, extending from its opposite side over the insulating pad 62 and in registry with but laterally spaced from the section 63.

A transparent conductive coating 76 is then deposited in registry over the band 70 and the phosphor loaded dielectric matrix coating 64. The transparent conductive layer 76 is preferably formed from an indium-tin oxide or simply indium oxide coating in a convention solvent based or UV based composition. In the latter case the transparent conductive coating 76 would be cured by exposure to a source of ultraviolet radiation. The transparent conductive layer 76 may also be formed by bonding a transparent conductive substrate such as 12 in FIG. 1 over the band 70. The silver conductive band 70 functions as an electrical bus bar to uniformly distribute an applied EMF over the surface of the transparent conductive coating 76. The applied EMF is provided by coupling the electrical leads formed through the exposed section 63 and the pigtail 74 to a source of alternating potential (not shown) using a conventional connector (not shown).

A protective coating 78 may be applied over the surface of the transparent conductive coating 76. The protective coating 78 should leave a predetermined length of the electrical leads 63 and 74 exposed. Another protective coating 79 may, if desired, be applied to the undersurface of the non-transparent conductor 60. The protective coating(s) may be screen printed or laminated in a manner corresponding to the formation of the protective coatings 35 and 40 to form the finished lamp assembly 11.

The insulating pad 19 in FIG. 1 and the insulating pad 62 in FIG. 2 is employed solely to isolate the electrical leads and to permit connection to a standard connector. It should be apparent that other printing or masking techniques or assembly arrangements may be employed which may obviate the need for the insulating pads or for using the pads in the precise manner discussed in connection with the embodiments of FIGS. 1 and 2. For example in the FIG. 1 embodiment if a plastic sheet is used as a substrate the conductor may be coated over a predetermined area defined by the area of the dielectric matrix and thereby avoid the need for the dielectric pad. Also in the FIG. 2 embodiment the non-transparent conductor may be formed with an extended section representing an electrical lead. If the non-transparent conductor is then coated on an insulative substrate the need for the insulating pad is avoided.

I claim:

1. A method of constructing a thin electroluminescent lamp comprising the steps of:

(a) screen printing a band of silver conductive material substantially around the edges of a circumscribed area of a transparent conductive substrate with said area conforming to the desired configuration for the lamp and with said band forming an electrical bus bar for the lamp;

(b) forming an insulated support area over a section of said transparent conductive substrate extending from said silver conductive bus bar;

(c) depositing a finger-like section of silver conductive material over said insulated support area and extending from said bus bar to form a first electrical lead;

(d) forming a UV curable dielectric matrix by loading nonencapsulated particles of electroluminescent phosphor into a UV curable dielectric composition;

(e) depositing a coating of said UV curable dielectric composition over said circumscribed area of the transparent conductor and over said silver conductive bus bar;

(f) curing said coating composition by exposure to a source of ultraviolet light in a substantially inert atmosphere;

(g) superimposing a layer of a nontransparent conductive material over the surface of the UV curable dielectric coating with said nontransparent conductive layer having an elongated finger-like section extending over said insulating support area to form a second electrical lead laterally spaced from said first electrical lead; and (h) applying a protective coating over said conductive layer and at least a portion of said first and second electrical leads.

2. A method as defined in claim 1 wherein said transparent conductor is formed by depositing a thin layer of conductive particles selected from the group consisting of gold, indium tin oxide and indium oxide over the surface of a transparent sheet of a resinous material.

3. A method as defined in claim 2 wherein said phosphor particles in said UV curable dielectric matrix comprises at least about 50% by weight of the total composition.

4. A method as defined in claim 3 wherein said nontransparent conductive layer is formed by coating the surface of said UV curable dielectric coating with a conductive composition and curing said conductive composition.

5. A method as defined in claim 3 wherein said nontransparent conductive layer is formed by bonding a layer of conductive sheet material to said UV curable dielectric coating.

6. A method of constructing a thin electroluminescent lamp comprising the steps of:

(a) depositing a layer of a transparent conductive material, upon an insulating substrate to form a predetermined shape substantially conforming to the desired configuration for the lamp, with the transparent conductor having an elongated finger-like section forming a first electrical lead for the lamp;

(b) screen printing a band of silver conductive material substantially around the edges of the predetermined shape formed by said transparent conductor for forming an electrical bus bar for the lamp;

(c) forming a UV curable dielectric matrix by loading nonencapsulated particles of electroluminescent phosphor into a UV curable dielectric composition;

(d) depositing a coating of said UV curable dielectric composition over the transparent conductor and over said silver conductive bus bar with said first electrical lead exposed;

(e) curing said coating composition by exposure to a source of ultraviolet light in a substantially inert atmosphere;

(f) superimposing a layer of a nontransparent conductive material over the surface of the UV curable dielectric coating with said nontransparent conductive layer having an elongated finger-like section extending over said insulating substrate in registry with and laterally spaced from said first electrical lead to form a second electrical lead;

(g) applying a protective coating over said nontransparent conductive layer and extending over at least a portion of said first and second electrical leads.

7. A method as defined in claim 6 wherein said transparent conductor is formed by depositing a thin layer of conductive particles selected from the group consisting of gold, indium tin oxide and indium oxide over the surface of a transparent sheet of a resinous material.

8. A method as defined in claim 7 wherein said phosphor particles in said UV curable dielectric matrix comprises at least about 50% by weight of the total composition.

9. A method as defined in claim 8 wherein said nontransparent conductive layer is formed by coating the surface of said UV curable dielectric coating with a conductive composition and curing said conductive composition.

10. A method as defined in claim 9 wherein said nontransparent conductive layer is formed by bonding a layer of conductive sheet material to said UV curable dielectric coating.

11. A method of constructing a thin electroluminescent lamp comprising the steps of:

(a) forming a UV curable dielectric matrix by loading nonencapsulated particles of electroluminescent phosphor into a UV curable dielectric composition;

(b) depositing a coating of such composition upon a predetermined surface area of a nontransparent conductor, said area conforming to the desired configuration for the lamp and with said nontransparent conductor having a predetermined finger-like section forming a first electrical lead for the lamp;

(c) curing said coating composition by exposure to a source of ultraviolet light in a substantially inert atmosphere;

(d) forming an insulated support area over a section of said nontransparent conductor adjacent to said predetermined surface area and said first electrical lead;

(e) screen printing a band of silver conductive material substantially around the periphery of said coating of dielectric matrix composition for forming a bus bar for the lamp;

(f) screen printing a finger-like extension of said silver conductive material from said bus bar over said insulated support area to form a second electrical lead adjacent to said first electrical lead;

(g) superimposing a coating of a transparent conductive material over said coating of dielectric matrix material and over said bus bar; and (h) applying a protective coating over said transparent conductive coating and extending over at least a portion of said first and second electrical leads.

12. A method as defined in claim 11 wherein said transparent conductor is formed by depositing a thin layer of conductive particles selected from the group consisting of gold, indium tin oxide and indium oxide over the surface of a transparent sheet of a resinous material.

13. A method as defined in claim 12 wherein said phosphor particles in said UV curable dielectric matrix comprises at least about 50% by weight of the total composition.

14. A method as defined in claim 13 wherein said nontransparent conductive layer is formed by coating the surface of said UV curable dielectric coating with a conductive composition and curing said conductive composition.

15. A method as defined in claim 14 wherein said nontransparent conductive layer is formed by bonding a layer of conductive sheet material to said UV curable dielectric coating.

16. A method of constructing a thin electroluminescent lamp comprising the steps of:

(a) depositing a layer of nontransparent conductive material, having a predetermined shape substantially conforming to the desired configuration for the lamp, upon an insulating substrate, with the nontransparent conductor having an elongated finger-like section for forming a first electrical lead for the lamp;

(b) forming a UV curable dielectric matrix by loading nonencapsulated particles of electroluminescent phosphor into a UV curable dielectric composition;

(c) depositing a coating of such matrix material composition over said layer of nontransparent conductive material with said first electrical lead exposed;

(d) curing said coating by exposure to ultraviolet light in a substantially inert atmosphere;

(e) screen printing a band of silver conductive material substantially around the periphery of said dielectric matrix coating for forming a bus bar for the lamp;

(f) screen printing a finger-like extension of said silver conductive material from said bus bar over said insulating substrate to form a second electrical lead adjacent to said first electrical lead;

(g) superimposing a coating of a transparent conductive material over said coating of dielectric matrix material and over said bus bar; and (h) applying a protective coating over said transparent conductive coating and extending over at least a portion of said first and second electrical leads.

17. A method as defined in claim 5 wherein said phosphor particles in said UV curable dielectric matrix comprises at least about 50% by weight of the total composition.

18. A method as defined in claim 17 wherein said nontransparent conductive layer is formed by coating with a conductive composition and curing said conductive composition.

19. A method as defined in claim 19 wherein said nontransparent conductive layer is formed by bonding a layer of conductive sheet material to said UV curable dielectric coating.

* * * * *